US005430628A

United States Patent [19]

Saunders

[11] Patent Number: 5,430,628

[45] Date of Patent: Jul. 4, 1995

[54] LIGHT ACCENTED SERVING TRAY

[76] Inventor: Timothy R. Saunders, 3434 Serene Grove, San Antonio, Tex. 78247

[21] Appl. No.: 179,149

[22] Filed: Jan. 10, 1994

[51] Int. Cl.[6] ..... F21V 33/00

[52] U.S. Cl. ..... 362/253; 362/154; 362/184; 362/234

[58] Field of Search ..... 362/31, 96, 97, 109, 362/154, 184, 191, 234, 253, 800, 806; 40/324, 564

[56] References Cited

U.S. PATENT DOCUMENTS

| | | | |
|---|---|---|---|
| 2,114,460 | 4/1938 | Ziegler | 362/97 |
| 2,352,493 | 6/1944 | Palmer | 362/154 |
| 3,378,680 | 4/1968 | Moxley | 362/191 |
| 3,705,982 | 12/1972 | Smolinski | 362/97 |
| 4,217,625 | 8/1980 | Klein | 362/800 |
| 4,254,452 | 3/1981 | Switala | 362/154 |
| 4,446,508 | 5/1984 | Kinzie | 362/31 |
| 4,640,033 | 2/1987 | Bulger | 40/324 |
| 4,803,604 | 2/1989 | Nichols et al. | 362/154 |

*Primary Examiner*—Ira S. Lazarus
*Assistant Examiner*—Y. Quach
*Attorney, Agent, or Firm*—David G. Henry

[57] ABSTRACT

The invention includes a lighted serving tray comprised of a discus shaped platter with an interior hollow in which a tubular light array is positioned. The tray includes a serving surface upon which drink glasses are to be placed, and which includes a clear, lens portion through which light is transmitted to illuminate an etched sponsor logo. The base portion of the tray is, in one embodiment, a translucent and is colored to transmit colored light during use. A change/power case is affixed to the tray to house a power supply and to provide a change compartment for use by wait staff.

18 Claims, 2 Drawing Sheets

LIGHT ACCENTED SERVING TRAY

BACKGROUND OF THE INVENTION

1. Field of The Invention

Applicant's invention relates to serving implements used in the restaurant, bar and night club market, particularly to serving trays used primarily to serve beverages.

2. Background Information

Particularly in this "high tech" entertainment age, it is a constant struggle for bars and night clubs to capture and maintain the interest of their patrons. With the advent of state-of-the-art home theater, video games, music videos, and other relatively new avenues for entertainment, potential patrons for bars and night clubs must encounter a "dazzling" environment if they are to be lured back for repeat business.

In many market niches, the preferred environment for night clubs is one of a futuristic or high tech feel. Thus, many such establishments invest heavily in lighting and decorations to achieve such a "feel".

An attractive adjunct to the permanent fixtures of a futuristic night club is that of lighted serving trays for use by wait persons who serve mixed drinks. Serving trays with integral lighting were once known, but they were of little practical use. Earlier trays included an array of pin point lights over each one of which a single drink glass is to be placed. The light from each light bulb is supposed to be reflected throughout any drink glass placed over the bulb to give a dramatic visual effect, particularly in a darkened night club atmosphere.

The earlier tray systems worked reasonably well in theory, but in practice there are serious drawbacks. Because the light is emitted from the prior art serving tray at very localized points, positioning of the drinks on the tray is critical to achieve the desired visual effect. Busy wait persons simply do not, in the real world, take time to meticulously position and thereafter maintain drink glasses on specific locations on a drink tray.

What is needed to fully benefit from the concept of lighted serving trays for use in night clubs and bars is a serving tray which: (1) emits light in a generalized fashion whereby any drink glass on the tray surface will "pick up" the light; (2) is fabricated from materials which are light enough to avoid unnecessary fatigue or proclivity for dropping trays on the wait persons' behalf; (3) is durable for withstanding the rigors of night club and bar use; and (4) are constructed in such a manner that they can be purchased by club owners at cost effective prices. In addition, it is believed that the ability to highlight beverage vendors' logos with emissions from the tray's light source would promote cost share or out right donation of trays by vendors to clubs.

SUMMARY OF THE INVENTION

It is an object of the present invention to provide a novel an improved lighted serving tray for use in night clubs and bars.

It is another object of the present invention to provide a lighted serving tray which provides a safety benefit for users in darkened environments, such as bars and night clubs.

It is another object of the present invention to provide a serving tray which is aesthetically appealing.

It is another object of the present invention to provide a serving tray which serves as an advertizing platform in other than mere print forms.

It is yet another object of the present invention to provide an improved serving tray which emits light through drink glasses placed thereon to provide a visually appealing display.

In satisfaction of these and related objectives, Applicant's present invention provides a lighted serving tray which emits light, both through its case, and through drink glasses placed thereon. Applicant's tray is constructed to transmit light from virtually any point on the serving surface, as well as through the base which is of a translucent colored material. The tray is both visually appealing and provides a safety visual device for drawing attention to a user's path through a darkened area.

DETAILED DESCRIPTION OF THE PREFERRED EMBODIMENT

Figure 1:
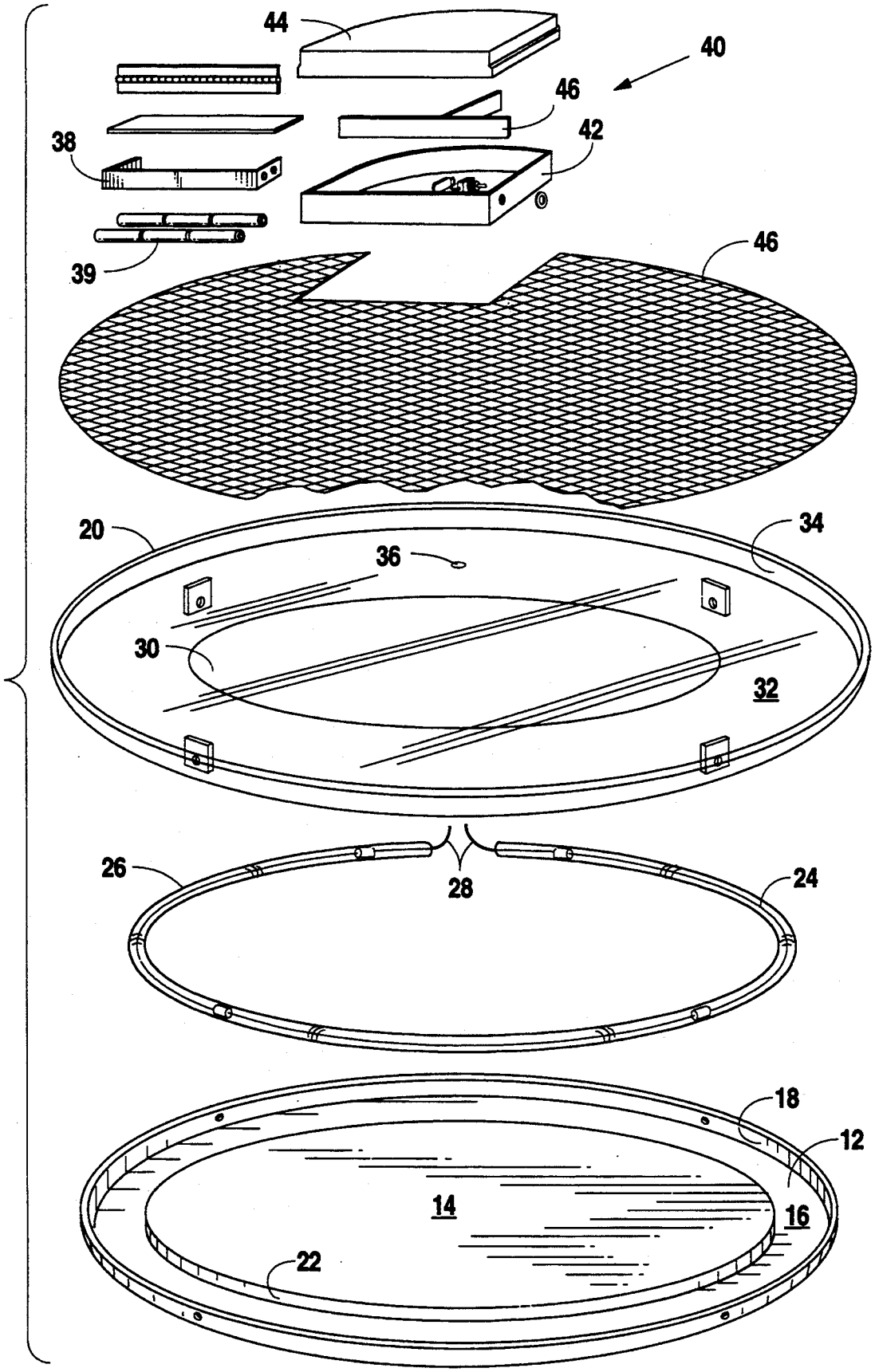
FIG. 1 is an exploded perspective view of a tray of the preferred embodiment.
Figure 2:
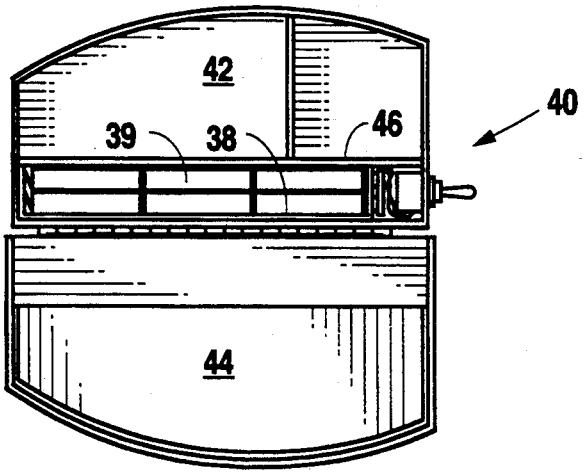
FIG. 2 is a top plan view of the change/power case of the tray of FIG. 1.
Figure 3:
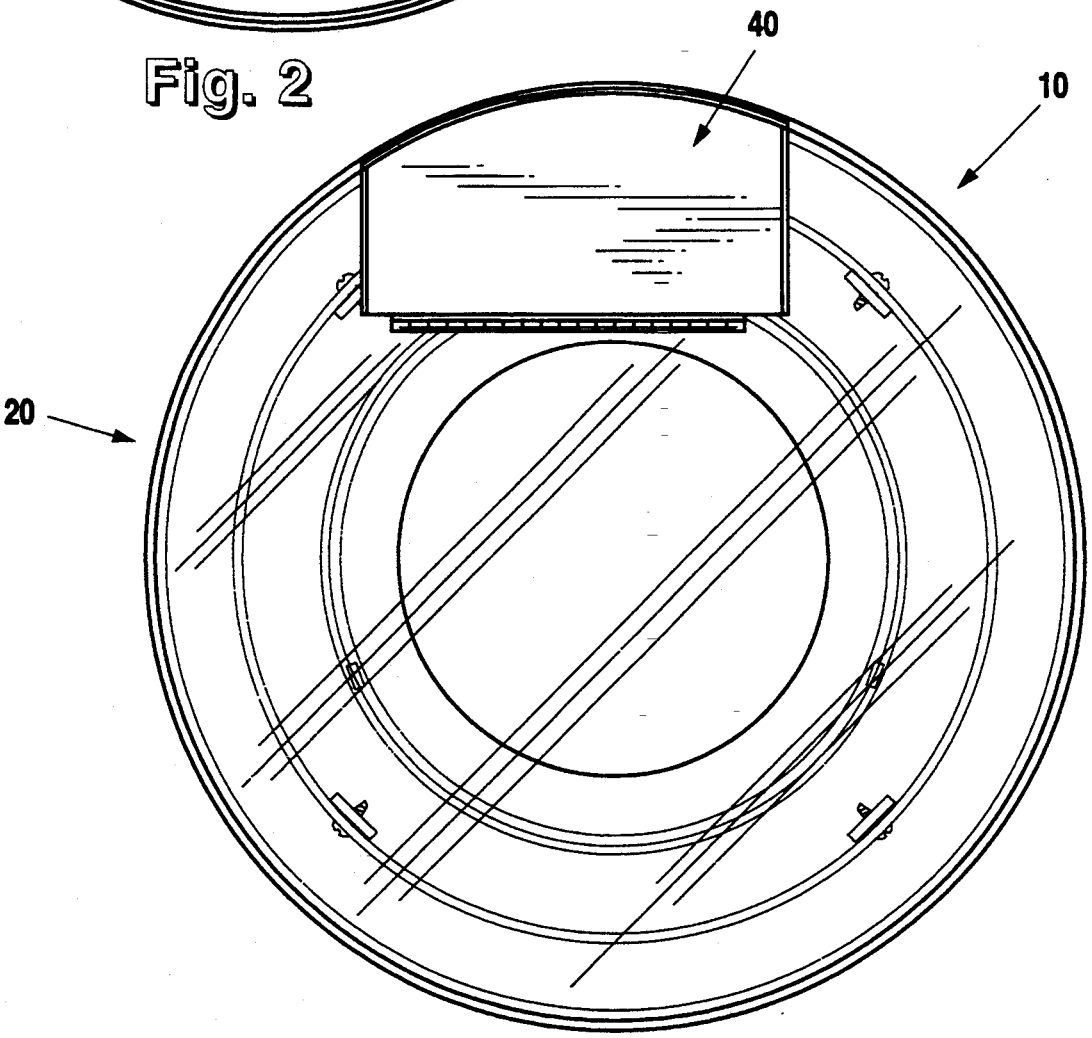
FIG. 3 is a top plan view of the tray of FIG. 1
Figure 4:
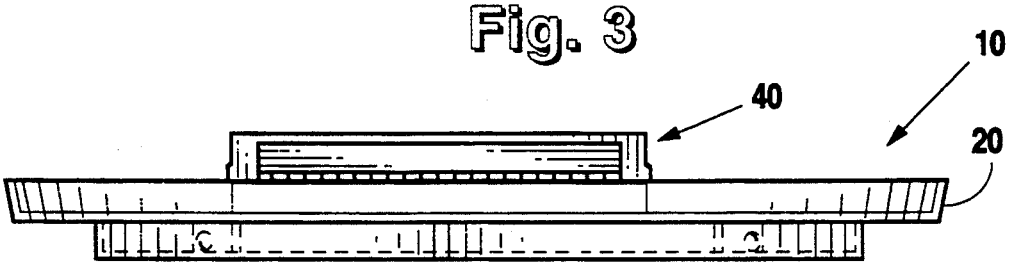
FIG. 4 is a side elevational view of the tray of FIG. 1.

Referring to FIG. 1, the tray representing the preferred embodiment of Applicant's invention is identified generally by the reference numeral 10.

The foundation of tray 10 is a base plate 12. Base plate 12 is, in the preferred embodiment, a circular, platter-like structure formed either from opaque or clear molded plastic. In the former case, the base can be made from ABS black plastic and in the latter case from P.E.T.G. plastic. The clear plastic is used for the base, a coat of colored paint (common spray paint will work) is applied to the interior surfaces with the result being that light from the internal light sources of tray 10 (to be discussed in more detail hereafter) is transmitted, in the color of the paint applied to base plate 12, through base plate 12 for a very appealing visual effect.

Base plate 12 is of a unitary design, but is visually and functionally divisible into three sections: (1) a circular, planer surface platform section 14 centered about the axis of symmetry of the base plate 12; (2) a recessed trough portion 16 circumferentially surrounding platform section 14; and (3) a rim 18 which is disposed about the margin of trough portion 16 and which defines a circular interior surface with which the exterior margin of light transmission plate 20 (to be described in more detail hereafter) mates in a nesting arrangement.

The transition between platform section 14 and trough portion 16 defines a circumferential abutment 22 at the outer margin of platform section 14. Sized and shaped to substantially surround and abut abutment 22 is a tubular light array 24. Light array 24, in the preferred embodiment, comprises a clear vinyl tube 26 in which is positioned at substantially equidistant intervals three 1.5 volt halogen bulbs (not individually visible in the drawings) which bulbs are wired in series. Suitable bulbs are those 1.5 volt halogen lamps marketed under the trademark MAGLIGHT.

Both termini of the vinyl tube are sealed to a watertight closure with a suitable curable material with only wire leads 28 extending from either end of the vinyl tube. Sealing is important to prevent moisture from entering the vinyl tube 26 and corroding the lamp/wire interfaces.

Overlying the combination of base plate 12 and light array 24 is a light transmission plate 20. Light transmission plate 20 is a fabricated from P.E.T.G. plastic. In the preferred embodiment, light transmission plate 20 comprises a central, lens section 30 which is fabricated to be substantially clear and a surrounding, annular frosted section 32 which is textured. The central lens section 30 of the preferred embodiment is intended for use as a promotional space. Particularly by etching a sponsor's logo on the lens section 30 (painting would be a less desirable alternative), the logo would be clearly visible to patrons as drinks are removed from the tray. This feature of tray 10 creates the likelihood that beverage vendors in particular will pay at least a portion of the purchase price of such trays for bar and club owners.

At the outer margin of light transmission plate 20 is a lip 34 which is sized and shaped for nesting reception within the interior surface of rim 18 of base plate 12. Once in such a nesting configuration, base plate 12 and light transmission plate 20 are affixed one to the other using screws. Screws over preferable a glue or other adhesive because they facilitate later repairs to tray 10, such as replacing light arrays 24.

A small hole 36 passes through annular frosted section 32 of light transmission plate 20 through which wire leads 28 extend from light array 24 above light transmission plate 20.

Power for light array 24 is provided by a battery pack 38 in which, for the preferred embodiment, six AA sized batteries 39 are placed. Wiring and circuitry between light array 24 and battery pack 38 and batteries 39 are well known in the art and need not be reiterated here.

Battery pack 38 is housed in a change/power case 40. Change/power case 40 is fabricated from a case base 42 and a case lid 44. A divider 46 delineates at least two spaces inside case base 42, a first for the battery pack 38 and a second for holding coins and bills for making change with patrons.

A portion of the exterior margin of change/power case 40 is shaped to mate with the inner surface of lip 34 of light transmission plate 20. Change/power case 40 is preferably attached to light transmission plate 20 using adhesives. Change/power case 40 is fabricated from ABS black plastic in the preferred embodiment.

Optionally overlying light transmission plate 20 is a polyurethane grid 46 which provides a frictional resistant surface on which glasses may rest as wait staff move drinks about the establishment.

An assembled and operating tray 10 presents an impressive visual impact in a darkened bar or night club. Light is transmitted through each glass and the contents thereof as are placed on the tray 10. Different colors of drinks (beer, wine, mixed drinks, etc.) render a multicolored display. The "big picture view" of multiple wait staff carrying light trays 10 through a busy establishment creates an exciting and stimulating impression for patrons.

The use of a tubular light array 24, rather than individual, exposed bulbs within the tray enclosure, together with the juxtaposition of the light array 24 with abutment 22 causes light to be substantially uniformly transmitted throughout the light-transmissive materials forming tray 10. This provides a substantially improved visual effect, both through the base plate 12 (when the clear/painted plastic materials are used) and through drink glasses placed on tray 10, regardless of their positioning on the tray 10.

A safety dividend of tray 10 should not be overlooked in considering its utility. Particularly when the clear plastic/color painted version of base plate 12 is used, patrons (and other wait staff) can easily see anyone carrying tray 10, even in the darkest of environments. In this litigation prone era, such a safety measure, however minimal at first impression, might well prove very beneficial, not only in preventing accidents, but in shifting blame from an establishment owner to a careless patron who "couldn't see the wait staff coming even when they had warning lights".

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A lighted serving tray comprising:

a serving tray enclosure having a substantially planer serving surface, said serving tray enclosure defining an interior space;

a tubular light array positioned within said serving tray enclosure, said light array having wire leads;

a power source positioned in proximity to said serving tray enclosure and connected to said wire leads for providing power to said light array;

said serving tray enclosure comprising a base plate and a light transmission plate, said base plate exhibiting a substantially planer platform surface lying in a first plane, a trough portion circumscribing said platform surface in a parallel and spatially separate second plane, with an abutment surface, substantially orthogonal to both said first and second planes, defining a transitional structure from said platform surface to said trough portion, said tubular light array being positioned to lie against said abutment surface and to thereby facilitate transmission of light from said light array through material forming said base plate, said light transmission plate being sized and shaped to overlie and contact said platform surface of said base plate and, with said trough portion and said abutment surface of said base plate, to complete an enclosure in which said light array resides.

2. The lighted serving tray of claim 1 wherein said light transmission plate includes a substantially clear lens portion which overlies and substantially conforms to the size and shape of said platform surface of said base plate, said light transmission plate being fabricated from a substantially clear plastic material.

3. The lighted serving tray of claim 2 wherein said base plate is fabricated from substantially clear plastic material.

4. The lighted serving tray of claim 3 wherein said base plate is coated with colored, translucent paint.

5. The lighted serving tray of claim 4 further comprising:

a change/power case affixed to said tray, and including an enclosure for said power source and a compartment for money.

6. The lighted serving tray of claim 3 further comprising:

a change/power case affixed to said tray, and including an enclosure for said power source and a compartment for money.

7. The lighted serving tray of claim 2 wherein a logo is etched upon a portion of said clear lens portion of said light transmission plate.

8. The lighted serving tray of claim 7 wherein said base plate is fabricated from substantially clear plastic material.

9. The lighted serving tray of claim 8 wherein said base plate is coated with colored, translucent paint.

10. The lighted serving tray of claim 9 further comprising:

a change/power case affixed to said tray, and including an enclosure for said power source and a compartment for money.

11. The lighted serving tray of claim 8 further comprising:

a change/power case affixed to said tray, and including an enclosure for said power source and a compartment for money.

12. The lighted serving tray of claim 1 wherein said base plate is fabricated from substantially clear plastic material.

13. The lighted serving tray of claim 5 wherein said base plate is coated with colored, translucent paint.

14. The lighted serving tray of claim 13 further comprising:

a change/power case affixed to said tray, and including an enclosure for said power source and a compartment for money.

15. The lighted serving tray of claim 12 further comprising:

a change/power case affixed to said tray, and including an enclosure for said power source and a compartment for money.

16. The lighted serving tray of claim 1 further comprising:

a change/power case affixed to said tray, and including an enclosure for said power source and a compartment for money.

17. The lighted serving tray of claim 2 further comprising:

a change/power case affixed to said tray, and including an enclosure for said power source and a compartment for money.

18. The lighted serving tray of claim 7 further comprising:

a change/power case affixed to said tray, and including an enclosure for said power source and a compartment for money.

* * * * *